US009322100B2

(12) United States Patent
Manier et al.

(10) Patent No.: US 9,322,100 B2
(45) Date of Patent: Apr. 26, 2016

(54) METHOD FOR MANUFACTURING AN ABRASIVE COATING ON A GAS TURBINE COMPONENT

(75) Inventors: Karl-Heinz Manier, Scheyern (DE); Ilya Chuprakov, Burlington (CA); Robert Sparling, Mississauga (CA)

(73) Assignees: MTU Aero Engines GmbH, Munich (DE); Liburdi Engineering Limited, Hamilton (CA)

( * ) Notice: Subject to any disclaimer, the term of this patent is extended or adjusted under 35 U.S.C. 154(b) by 1737 days.

(21) Appl. No.: 12/451,263

(22) PCT Filed: May 4, 2007

(86) PCT No.: PCT/IB2007/002079

§ 371 (c)(1),
(2), (4) Date: Mar. 8, 2010

(87) PCT Pub. No.: WO2008/135803

PCT Pub. Date: Nov. 13, 2008

(65) Prior Publication Data

US 2010/0173094 A1 Jul. 8, 2010

(51) Int. Cl.
*B05D 5/06* (2006.01)
*H05B 6/02* (2006.01)
(Continued)

(52) U.S. Cl.
CPC ..... *C23C 24/10* (2013.01); *C23C 30/00* (2013.01); *F01D 5/288* (2013.01); *F05D 2230/30* (2013.01); *F05D 2230/40* (2013.01); *F05D 2300/228* (2013.01); *F05D 2300/2283* (2013.01)

(58) Field of Classification Search
CPC ..... C23C 24/10; C23C 30/00; F01D 5/288
USPC ..... 427/189, 190, 191, 201, 202, 543, 591
See application file for complete search history.

(56) References Cited

U.S. PATENT DOCUMENTS 4,257,741 A * 3/1981 Betts et al. ..... 416/190
4,610,698 A 9/1986 Eaton et al. ..... 51/295
(Continued)

FOREIGN PATENT DOCUMENTS

EP 0 573 928 12/1993
GB 2 108 534 5/1983

OTHER PUBLICATIONS

Search Report of PCT/IB2007/002079 (3 pages).
(Continued)

*Primary Examiner* — Michael Wieczorek
(74) *Attorney, Agent, or Firm* — Davidson, Davidson & Kappel, LLC

(57) ABSTRACT

A method for manufacturing an abrasive coating on a gas turbine component, especially on a gas turbine rotor blade tip, comprising at least the following steps: a) providing a gas turbine component, especially a gas turbine rotor blade; b) providing a high temperature melting alloy powder; c) providing abrasive particles; d) providing a low temperature melting alloy powder; e) blending at least said high temperature melting alloy powder and said abrasive particles to provide a mixture; f) applying said low temperature melting alloy powder and said mixture to an area of said gas turbine component, especially to a tip of said turbine rotor blade; g) locally heating said area of said gas turbine component to a temperature above the melting point of said low temperature melting alloy powder but below the melting point of said high temperature melting alloy powder is provided.

20 Claims, 1 Drawing Sheet

(51) Int. Cl.

| | |
|---|---|
| ***H05B 6/46*** | (2006.01) |
| ***C23C 24/10*** | (2006.01) |
| ***C23C 30/00*** | (2006.01) |
| ***F01D 5/28*** | (2006.01) |

(56) References Cited

U.S. PATENT DOCUMENTS

| | | | | | |
|---|---|---|---|---|---|
| 4,735,656 | A | * | 4/1988 | Schaefer et al. | 75/238 |
| 4,851,188 | A | * | 7/1989 | Schaefer et al. | 419/9 |
| 5,359,770 | A | | 11/1994 | Brown et al. | 29/889.1 |
| 5,655,701 | A | * | 8/1997 | Quattrocchi et al. | 228/119 |
| 5,660,320 | A | | 8/1997 | Hoffmuller et al. | 228/122.1 |
| 6,194,086 | B1 | | 2/2001 | Nenov et al. | 428/621 |
| 6,355,086 | B2 | | 3/2002 | Brown et al. | 75/235 |
| 6,451,454 | B1 | * | 9/2002 | Hasz et al. | 428/668 |
| 6,706,319 | B2 | | 3/2004 | Seth et al. | 427/190 |
| 6,811,898 | B2 | * | 11/2004 | Ohara et al. | 428/697 |
| 2003/0183529 | A1 | | 10/2003 | Ohara et al. | 205/109 |
| 2004/0091627 | A1 | * | 5/2004 | Ohara et al. | 427/402 |

OTHER PUBLICATIONS

Li J P et al:"A novel porous Ti6Al4V Characterization and cell attachment", Journal of Biomedical Materials Research. Part A, Wiley Periodicals Inc. Hoboken, NY, US, vol. 73 a, No. 2, May 1, 2005 pp. 223-233.

* cited by examiner

METHOD FOR MANUFACTURING AN ABRASIVE COATING ON A GAS TURBINE COMPONENT

This is a national phase of international application PCT/IB2007/002079, filed May 4, 2007.

The invention relates to a method for manufacturing an abrasive coating on a gas turbine component, especially on a gas turbine rotor blade tip.

BACKGROUND OF THE INVENTION

During operation of a gas turbine, the gas turbine rotor blades of e.g. the turbine hot section of the gas turbine are exposed to elevated temperature gases and high rotational velocities. While gas turbine rotor blade tips may be coated as part of the manufacturing process, the tips may be "ground in the rotor" to ensure all the gas turbine rotor blades are the correct height and contoured properly. However during the grinding action, the protective coating is removed and environmentally sensitive base alloy of the gas turbine rotor blades is revealed. With thousands of subsequent hours of operation, the tips of the gas turbine rotor blades will oxidize, causing the gas turbine rotor blades to shorten, and allow for hot gases to escape past the tips instead of being captured by the airfoil for work. The result is a less efficient gas turbine.

The performance of gas turbines can be improved my by minimizing clearances between the tips of the gas turbine rotor blades and a stationary shroud or a stationary casing of the gas turbine. In order to maintain the requisite tight tolerances at the gas turbine rotor blade tips, an abrasive coating is applied to the rotor blade tips to preferentially cut into the shroud or the casing of the gas turbine. Cold tolerances between the shroud or casing and the rotor blade tip are designed such that as the rotor blade heats and expands, it contacts the shroud or the casing. During this contact, the rotor blades remove material from the shroud or the casing ensuring the clearance is minimal.

The abrasive coatings comprise abrasive particles embedded in a metal matrix. The present invention relates to a method for manufacturing an abrasive coating on a gas turbine component, especially on a gas turbine rotor blade tip.

Several process to manufacture an abrasive coating on a gas turbine component, especially on a gas turbine rotor blade tip, are known from the prior art.

U.S. Pat. No. 5,359,770 discloses a method for bonding abrasive blade tips to the tip of a rotor blade. This prior art discloses that abrasive blade tips may be applied as a separate step during manufacture, where an abrasive blade tip is brazed to the rotor blade tip at a maximum temperature of 1190° C., the blade tip having been manufactured with a cobalt-based boron containing alloy, and a boron containing braze. The rotor blade is heated uniformly to the processing temperature. For that, high temperatures may not be employed, since the consolidation temperature must be maintained below the temperature at which the base metal properties will be altered. Due to the concentrations of melting point depressants, namely boron, as well as the processing temperature a re-melting temperature of approximately 1200° C. may be expected.

U.S. Pat. No. 6,355,086 discloses a method on how to use direct laser processing to apply an abrasive blade tip to a gas turbine rotor blade post manufacture without having to subject the blade to potentially harmful temperature excursions. Due to the melting and re-solidification of the pre-alloyed powder, the material will show coring or a segregated microstructure.

According to U.S. Pat. No. 6,194,086 low pressure plasma spraying and according to U.S. Pat. No. 6,706,319 cold spraying have also been used in the past as a means to apply a metal matrix ceramic composite to tips of gas turbine rotor blades.

SUMMARY OF THE INVENTION

The present invention provides a new method for manufacturing an abrasive coating on a gas turbine component, especially on a gas turbine rotor blade tip, comprising at least the following steps: a) providing a gas turbine component, especially a gas turbine rotor blade; b) providing a high temperature melting alloy powder; c) providing abrasive particles; d) providing a low temperature melting alloy powder; e) blending at least said high temperature melting alloy powder and said abrasive particles to provide a mixture; f) applying said low temperature melting alloy powder and said mixture to an area of said gas turbine component, especially to a tip of said turbine rotor blade; g) locally heating said area of said gas turbine component to a temperature above the melting point of said low temperature melting alloy powder but below the melting point of said high temperature melting alloy powder.

The present invention provides a method for manufacturing an abrasive coating in which properties of areas or regions remote to the coated area, especially to the tip, are unaffected in the process.

The present invention provides a method for manufacturing an abrasive coating in which a high re-melt temperature in the coating in achieved.

BRIEF DESCRIPTION OF THE DRAWINGS

The present invention will be described in conjunction with the accompanying drawings.

DETAILED DESCRIPTION

The present invention relates to a new method for manufacturing an abrasive coating on a gas turbine component. The present invention will be described in connection with the coating of a tip of a gas turbine rotor blade. However, also other gas turbine components like stator blade tips can be coated according to the present invention.

In a first step of the method according to the present invention a gas turbine rotor blade having a tip 10 is provided.

In a second step of the method according to the present invention a high temperature melting alloy powder 11, and abrasive particles 12, and a low temperature melting alloy powder 13 are provided.

As high temperature melting alloy powder 11 a nickel based superalloy powder, or a cobalt based superalloy powder, or a MCrAlY powder is preferably provided.

As abrasive particles 12 cubic boron nitride particles, or silicon nitride particles, or silicon aluminium oxynitide particles, or aluminium oxide particles are preferably provided.

As low temperature melting alloy powder 13 a nickel based brazing alloy powder having a melting point below the melting point of said high temperature melting alloy powder 11 and below the melting point on the constituents of the turbine rotor blade tip 10 is preferably provided.

In a third step of the method according to the present invention said high temperature melting alloy powder 11 and said abrasive particles 12 are blended to provide a mixture.

Figure 1:
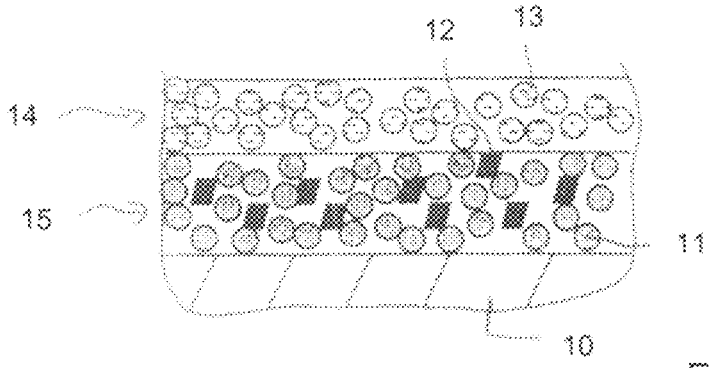
FIG. 1 is a schematic cross sectional view of a gas turbine rotor blade tip whereby material for manufacturing an abrasive coating is applied to the gas turbine rotor blade tip.

In a fourth step of the method according to the present invention said low temperature melting alloy powder 13 and said mixture are applied to the tip 10 of said turbine rotor blade. As shown in FIG. 1, the low temperature melting alloy powder 13 is applied as a separate layer 14 to the tip 10 of said turbine rotor blade, namely above a layer 15 of said mixture of said high temperature melting alloy powder 11 and said abrasive particles 12. The layer 15 is applied adjacent to the rotor blade tip 10. The layer 14 forms an outer layer.

In a fifth step of the method according to the present invention the tip 10 of said rotor blade is locally heated together with the two layers 14, 15 applied to the tip 10 to a temperature above the melting point of said low temperature melting alloy powder 13 but below the melting point of said high temperature melting alloy powder 11 and below the melting point of the constituents of the rotor blade tip 10, while maintaining the areas or regions remote from the tip 10 at a lower temperature whereby the properties of the blade alloy are unaffected. Preferably, induction heating as a localized heating source is used.

Figure 2:
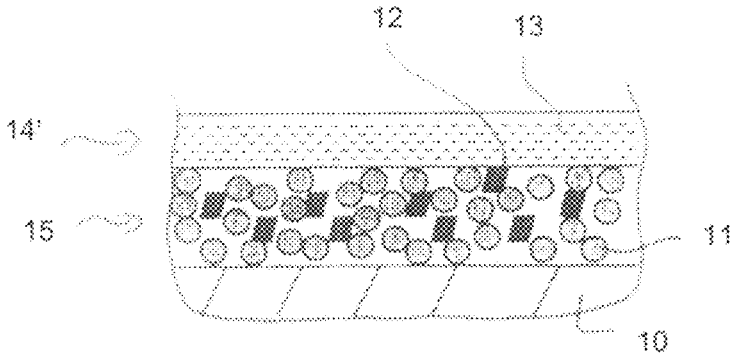
FIG. 2 is a schematic cross sectional view of the gas turbine rotor blade tip whereby the blade tip and the material applied to the blade tip is heated.
Figure 3:
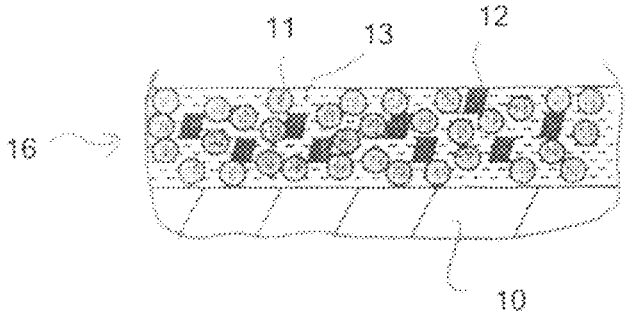
FIG. 3 is a schematic cross sectional view of the gas turbine rotor blade tip and the manufactured abrasive coating.

FIG. 2 shows that due to the heating the low temperature melting alloy powder 13 of the layer 14 melts forming a liquid layer 14'. The liquid layer 14' of the melted low temperature melting alloy powder 13 infiltrates according to FIG. 3 the layer 15 comprising the high temperature melting alloy powder 11 and the abrasive particles 12. As a result an abrasive coating 16 is provided on the gas turbine rotor blade tip 10 by bonding the abrasive particles 12 and the high temperature melting alloy powder 11 to the rotor blade tip 10. Preferably, the entire method is carried out in a vacuum environment or an inert environment.

In another embodiment of the present invention, it is also possible that within the fourth step of the method said low temperature melting alloy powder is blended together with said high temperature melting alloy powder and said abrasive particles to provide a mixture, whereby the low temperature melting alloy powder, the high temperature melting alloy powder and the abrasive particles are applied in a single layer to the tip of said turbine rotor blade.

What is claimed is:

1. A method for manufacturing an abrasive coating on gas turbine component, comprising at least the following steps:

a) providing a gas turbine component;

b) providing a high temperature melting alloy powder;

c) providing abrasive particles;

d) providing a low temperature melting alloy powder;

e) blending at least said high temperature melting alloy powder and said abrasive particles to provide a mixture;

f) applying said low temperature melting alloy powder and said mixture to a first area of said gas turbine component; and g) locally heating said first area of said gas turbine component to a first temperature above the melting point of said low temperature melting alloy powder but below the melting point of said high temperature melting alloy powder, while maintaining a second area of the gas turbine component adjacent to the first area at a second temperature lower than the first temperature.

2. The method according to claim 1 wherein said high temperature melting alloy powder is a nickel based superalloy powder.

3. The method according to claim 1 wherein said high temperature melting alloy powder is a cobalt based superalloy powder.

4. The method according to claim 1 wherein said high temperature melting alloy powder is a MCrAlY powder.

5. The method according to claim 1 wherein said abrasive particles are cubic boron nitride particles.

6. The method according to claim 1 wherein said abrasive particles are silicon nitride particles.

7. The method according to claim 1 wherein said abrasive particles are silicon aluminium oxynitride particles.

8. The method according to claim 1 wherein said low temperature melting alloy powder is nickel based brazing alloy powder having a melting point below the melting point of said high temperature melting alloy powder and below the melting point of the constituents of the first area of said gas turbine component.

9. The method according to claim 1 wherein the locally heating is accomplished by induction heating.

10. The method according to claim 1 wherein said low temperature melting alloy powder is applied in a separate layer to the first area of said gas turbine component above a layer of said mixture of said high temperature melting alloy powder and said abrasive particles.

11. The method according to claim 1 wherein within step e) said low temperature melting alloy powder is blended together with said high temperature melting alloy powder and said abrasive particles to provide a mixture, and that the low temperature melting alloy powder, the high temperature melting alloy powder and the abrasive particles are applied in a single layer to the area of said gas turbine component.

12. The method according to claim 1 wherein the method is carried out in a vacuum or inert environment.

13. The method according to claim 1 wherein the gas turbine component is a gas turbine rotor blade and the first area is a tip of the gas turbine rotor blade.

14. The method as recited in claim 1 wherein the gas turbine component is a blade and the first area is a first section of the blade.

15. The method as recited in claim 14 wherein the first section is a blade tip.

16. The method as recited in claim 1 wherein the mixture is applied directly to the first area.

17. The method as recited in claim 1 wherein the mixture is applied to the first area before the low temperature melting alloy powder is applied to the area.

18. The method as recited in claim 1 wherein the low temperature melting alloy powder forms an outer layer over the mixture before the locally heating step.

19. A method for manufacturing an abrasive coating on gas turbine component, comprising at least the following steps:

a) providing a gas turbine component;

b) providing a high temperature melting alloy powder;

c) providing abrasive particles;

d) providing a low temperature melting alloy powder;

e) blending at least said high temperature melting alloy powder and said abrasive particles to provide a mixture;

f) applying said low temperature melting alloy powder and said mixture to an area of said gas turbine component, the high temperature melting alloy powder having a first melting point while on the area of the gas turbine component; and g) locally heating said area of said gas turbine component to a temperature above the melting point of said low temperature melting alloy powder but below the melting point of said first melting point.

20. A method for manufacturing an abrasive coating on gas turbine component, comprising at least the following steps:

a) providing a gas turbine component;

b) providing a high temperature melting alloy powder;

c) providing abrasive particles;

d) providing a low temperature melting alloy powder;

e) blending at least said high temperature melting alloy powder and said abrasive particles to provide a mixture;

f1) applying said mixture to an area of said gas turbine component;

f2) applying said lower temperature meting alloy powder above the mixture; and g) locally heating said area of said gas turbine component to a first temperature above the melting point of said low temperature melting alloy powder but below the melting point of said high temperature melting alloy powder.

* * * * *